United States Patent [19]

Dunaevsky et al.

[11] 4,012,028

[45] Mar. 15, 1977

[54] FURNACE OF A CONTINUOUS METAL STRIP HEAT-TREATMENT PLANT

[76] Inventors: Vladimir Izrailevich Dunaevsky, ulitsa Oktyabrskoi Revoljutsii, 17, kv. 9, Slavyansk; Nikolai Mikhailovich Krikly, ulitsa Parkovaya, 69, kv. 67; Eduard Sergeevich Kotelevets, ulitsa Parkovaya, 3, kv. 25, both of Kramatorsk; Vladilen Nikolaevich Apterman, ulitsa V.Maslovka, 8, kv. 207; Mikhail Ilich Oginsky, ulitsa Zhukovskogo, 2, kv. 16, both of Moscow; Stanislav Tikhonovich Pliskanovsy, prospekt Lenina, 62, kv. 13, Zhdanov; Boris Ioinovich Kaushansky, ulitsa Karla Marxa, 28, kv. 2, Slavyansk, all of U.S.S.R.

[22] Filed: May 8, 1975

[21] Appl. No.: 575,965

[52] U.S. Cl. ..... 266/103; 148/156; 242/55; 242/55.16; 242/78.3

[51] Int. Cl.[2] ..... C21D 9/56; C21D 9/68

[58] Field of Search ..... 148/156; 242/55, 55.16, 242/74.1, 78.3; 266/3 R, 102, 103

[56] References Cited

UNITED STATES PATENTS

| | | | |
|---|---|---|---|
| 1,918,968 | 7/1933 | Keeney et al. | 242/74.1 X |
| 2,195,008 | 3/1940 | Lessmann | 242/55.16 X |
| 2,965,368 | 12/1960 | McIluried | 148/156 X |
| 3,011,733 | 12/1961 | Ford | 242/74.1 X |
| 3,021,128 | 2/1962 | Jonason | 266/3 R X |
| 3,206,777 | 4/1965 | Shibata | 242/55 X |

*Primary Examiner*—Roy Lake
*Assistant Examiner*—Paul A. Bell
*Attorney, Agent, or Firm*—Haseltine, Lake & Waters

[57] ABSTRACT

A furnace wherein a device for supporting a metal strip in its constrained motion during the heat treatment comprises a pair of parallel drums arranged in a thermoinsulated cell with a possible reversed rotation in the opposite directions and adopted for an alternate bifilar coiling of the metal strip and uncoiling thereof. In addition said device is provided for a pair of guide rolls pivoted with a possible motion parallel to the plane of the rotation axis of the drums. One of said rolls is installed in the thermo-insulated cell at the strip inlet side and used for inserting the metal strip into the drums before coiling it meanwhile another arranged at the strip outlet side serves for discharging said sheet metal strip from the drums upon finishing the unwinding of the coil. This furnace provides a long soaking of the metal strip having a comparatively high capacity at a continuous motion of the metal strip during its heat treatment.

3 Claims, 18 Drawing Figures

FIG.11
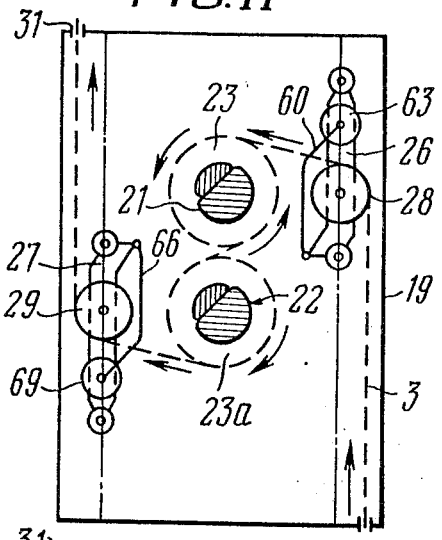
FIG.12
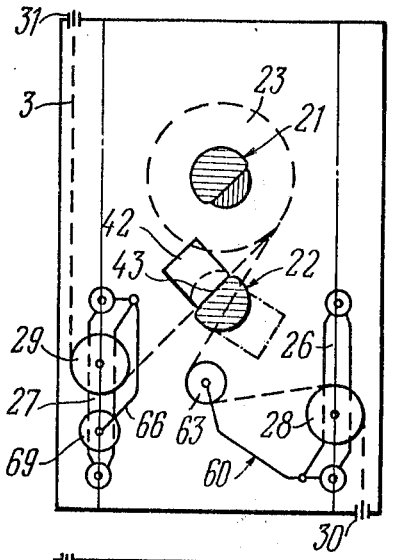
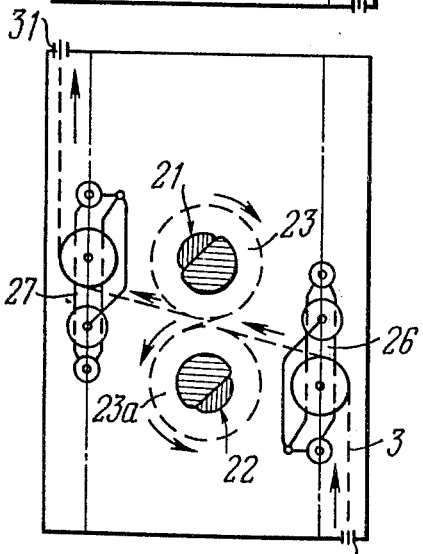
FIG.13
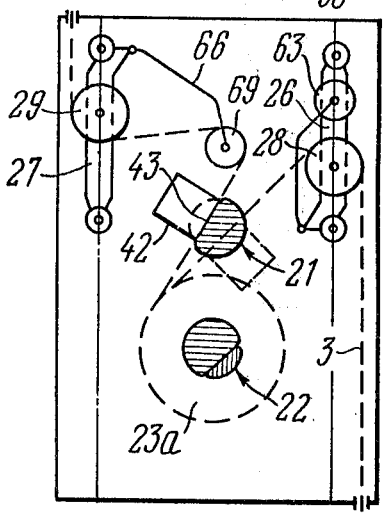
FIG.14

FIG.15
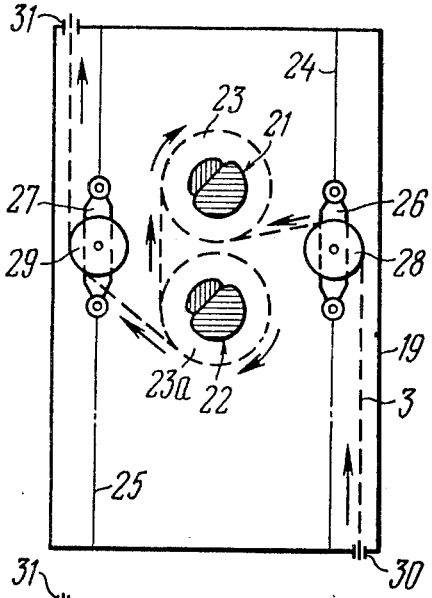
FIG.16
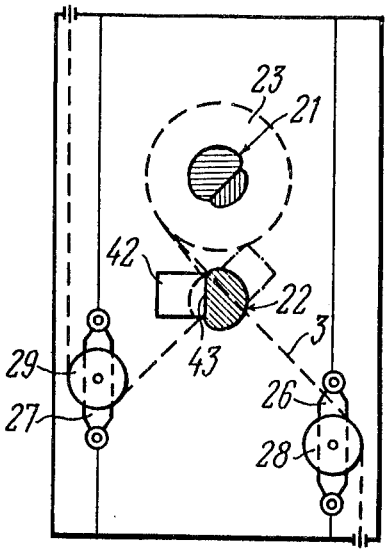
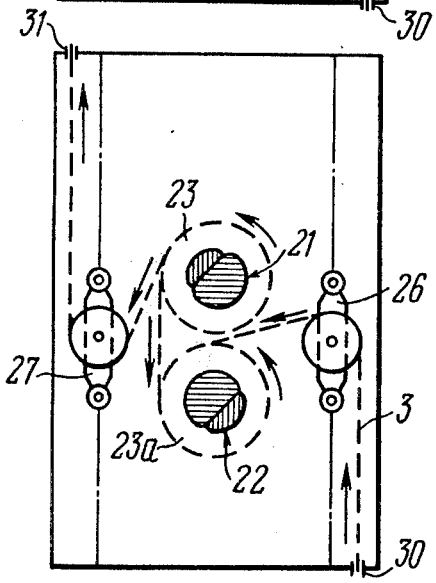
FIG.17
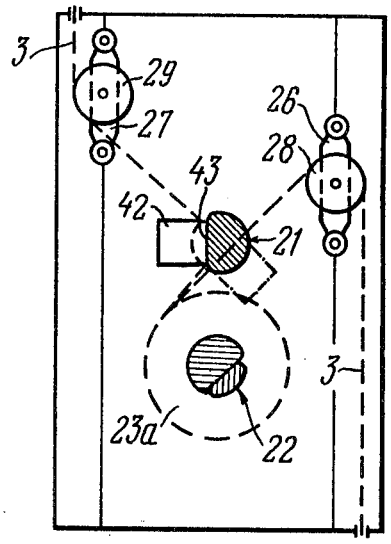
FIG.18

FURNACE OF A CONTINUOUS METAL STRIP HEAT-TREATMENT PLANT

The present invention relates to continuous metal strip heat-treatment plants and more particularly to furnaces thereof.

The furnaces according to the present invention can be used preferably in the plants wherein a long isothermal soaking of a continuously moving strip is required such as processes of homogenization and recrystallization annealing, process of a low temperature tempering to obtain the strips suitable for an intricate and very complicated stretching when stamping and the like.

Widely known in the art are continuous heat-treatment plants for moving metal strip referred hereinafter as a strip comprising consequently placed a device for uncoiling the strip and feeding it into a furnace; the furnace with heating and soaking zones; a device for chilling the strip and a device for coiling the strip into coils after heat treatment. In the known plants use is made of conveyor updraft furnaces consisting of a thermoinsulated cell accommodating heating elements and a device for supporting the strip in its constrained motion in this cell during the heat treatment. This device has two rows of parallel rolls. One of these rows is located at the top of the cell meanwhile another at the bottom thereof. The strip enveloping successively the rolls of the top and bottom rows forms loops in the cell. The rolls of one or both rows are driven for providing the constrained motion of the strip in the cell.

Since the rolls of one row are spaced from each other at a distance at least of two diameters a filling capacity of the cell with the processed strip is comparatively low and therefore the soaking of the strip in these furnaces can be carried out for a few minutes only.

For soaking the metal strip during some hours the dimensions of the thermoinsulated cell should be about 400m, thus being practically impossible.

At present the long soaking of the strip during its heat treatment is performed in hood-type furnaces. The hood-type furnaces have a thermoinsulated cell wherein heating elements are located.

The metal strip is coiled into coils prior to be placed into the thermoinsulated cell of the hood-type furnace. The coils are placed into the cell wherein they are heated, soaked and chilled successively.

Since the metal strip is coiled prior to be placed into the cell in the hood-type furnaces the filling capacity of the cell with strip is high and therefore the cells have comparatively small dimensions.

However the efficiency of the heat treatment of the metal strip in the hood-type furnaces is low since the time for heating the coiled strip up to a preset temperature and for a subsequent chilling is great, thus increasing to a considerable extent a cycle of the strip processing.

In addition the furnace capacity is reduced due to the time losses for placing the strip coils into the cell and removing them therefrom after the heat treatment.

It is an object of the present invention to eliminate the above-mentioned drawbacks.

The principal object of the present invention is to provide a furnace of a continuous metal strip heat-treament plant wherein a design embodiment of a device for supporting the metal.

It is an object of the present invention to provide such a furnace of a metal strip heat-treament plant wherein a design embodiment of a device for supporting the metal strip in its constrained motion in the thermoinsulated cell during its heat treatment should permit to increase the time for soaking the metal strip in the thermoinsulated cell at a comparatively small sizes of the furnace.

It is another object of the present invention to raise the capacity of the furnace.

These and other objects are accomplished by providing a furnace of a continuous metal strip heat-treatment plant with a thermoinsulated cell which accommodates heating elements and a device for supporting the metal strip in its constrained motion in the cell during its heat treatment wherein according to the invention said device consists of at least a pair of substantially parallel drums pivoted with a possible reversed rotation in the opposite directions with respect to each other and adapted for an alternate bifilar coiling of the strip and its subsequent uncoiling and at least a pair of guide rolls arranged in the thermoinsulated cell one roll of the pair being arranged at the strip inlet side and used for inserting the strip into the drums prior to its coiling meanwhile another arranged at the strip outlet side serves for discharging the strip from the drums after the uncoiling thereof whereas each of the guide rolls of this pair is pivoted with a possible displacement when inserting the strip into the drums or discharging said strip from the drums in the plane substantially parallel to the rotation axis of the drums.

Each drum can be collapsible preferably of two parts with a longitudinal plane of attachment for placing the metal strip between the contact surfaces of these parts wherein one part of the drum is pivoted with a possible constrained turn relative to an axle secured on another and perpendicular to its axis of rotation for separating these parts when inserting the strip into the drumms and discharging it from the drums.

This manufacturing of the drums provides a reliable discharge of the strip and its insert under tension.

Each guide roll of the pair can be still preferably secured on a carriage mounted in the guides fastened in the thermoinsulated cell.

The pair of the guide rolls mounted on the carriages permits to place the metal strip in parallel to the plane of attachment of the drums when inserting the strip thereinto. it is also preferable that mounted on the carriage placed in the thermoinsulated cell at the strip inlet side and carrying one roll of the pair should be a lever having an axis of rotation parallel to this guide roll and carrying on its arm an additional guide roll parallel to said roll and used to insert the metal strip into another drum meanwhile when inserting the strip another lever arm can actuate a drive for turning the lever for placing the additional guide roll relative to another drum in such a way that the sheet metal strip enveloping this roll should pass through the plane of attachment of this drum whereas mounted on the carriage placed in the thermoinsulated cell at the strip outlet side and carrying another roll of the pair used for discharging the metal strip from another drum should be a lever having an axis of turn parallel to this guide roll and carrying on its arm an additional guide roll being parallel to said roll and used for discharging the sheet metal strip from one drum meanwhile when discharging the metal strip another lever arm can interact with the drive of the lever for placing the additional guide roll relative to one drum in such a way that the metal strip enveloping this roll should pass through the plane of attachment of this drum.

Another pair of additional guide rolls mounted on the carriages permits to insert the strip into the drums and discharge it from them under tension.

The furnace of the continuous metal strip heat-treatment plant according to the present invention has comparatively small dimensions and permits to carry out a soaking of the metal strip for some hours in the course of the constrained motion thereof in the thermoinsulated cell of the furnace.

In addition the furnace according to the invention provides for a comparatively high capacity.

The specific features and advantages of the present invention will appear more completely from the following detailed description of a few preferred embodiments thereof which is given by way of an example with due reference to the accompanying drawings wherein:

FIG. 11 shows schematically a position of carriages relative to drums when the metal strip is coiled onto the top drum and uncoiled from the bottom drum in another embodiment of the furnace according to the invention;

FIG. 12 is the same view the metal strip at its outlet from the furnace cell is discharged from the bottom drum and another metal strip fed into the furnace cell is inserted into the drum;

FIG. 13 is the same view when the metal strip is coiled onto the bottom drum and uncoiled from the top drum;

FIG. 14 is the same view when the metal strip at its outlet from the furnace cell is discharged from the top drum and another metal strip fed into the furnace cell is inserted into this drum;

FIG. 15 shows schematically a position of the carriages relative to the drums when the metal strip is coiled onto the top drum and uncoiled from the bottom drum in another embodiment of the furnace according to the invention;

FIG. 16 is a view or FIG. 12 for the first embodiment of the furnace according to the invention;

FIG. 17 is a view of FIG. 13 for the first embodiment of the furnace according to the invention;

FIG. 18 is a view of FIG. 14 for the first embodiment of the furnace according to the invention.

The continuous metal strip heat-treatment plant consists of uncoilers 1 (FIG. 1) accommodating coils 2 of non-treated metal strip 3.

Figure 1:
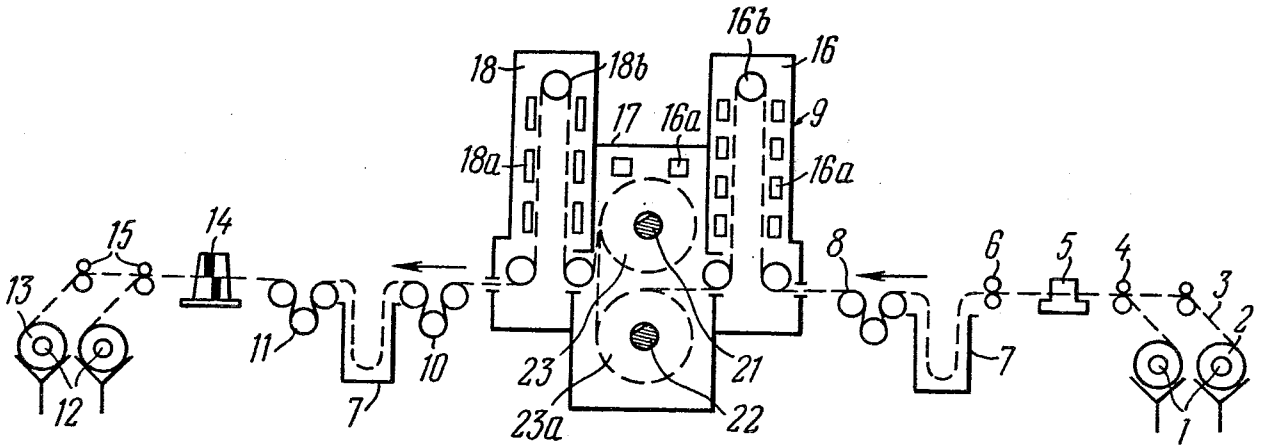
FIG. 1 shows schematically a continuous metal strip heat-treatment plant with a furnace according to the invention.

Mounted behind the uncoilers 1 are rolls 4 intended for feeding the strip 3 from the uncoilers 1 to a welding machine 5. Arrows in FIG. 1 show the direction of the motion of the metal strip 3. The welding machine 5 serves to join the ends of the strips. Dancer rolls 6 are mounted behind the uncoilers 1 to provide a tension of the strip 3. A looper 7 serves to provide self-contained operations of the independent sections of the plant. Dancer rolls 8 are placed behind said looper to provide the tension of the strip prior to a furnace 9.

From the furnace 9 the strip 3 is transported by dancer rolls 10. Behind the rolls 10 the second looper 7 is mounted. To provide a tension of the strip 3 prior to coilers 12 dancer rolls 11 are placed behind this looper. To cut out the strip after a coil 13 has been wound onto one of the coilers 12 use is made of dividing shears 14. The front end of the strip 3 is suppled by rolls 15 onto the second coiler 12 respectively.

The furnace 9 consists of three sections 16, 17 and 18 disposed successively along the motion of the strip 3.

The section 16 serves to heat the strip to a preset temperature. For the purpose heating elements **16*a* of any suitable design and support rolls 16*b*** are mounted therein.

The section 17 serves for soaking the hot strip for a preset time. Support rollers **16*b*** are also placed in this section.

The section 18 serves to chill the heat-treated strip. Coolers **18*a* of any suitable design and support rools 18*b*** are mounted therein.

Figure 2:
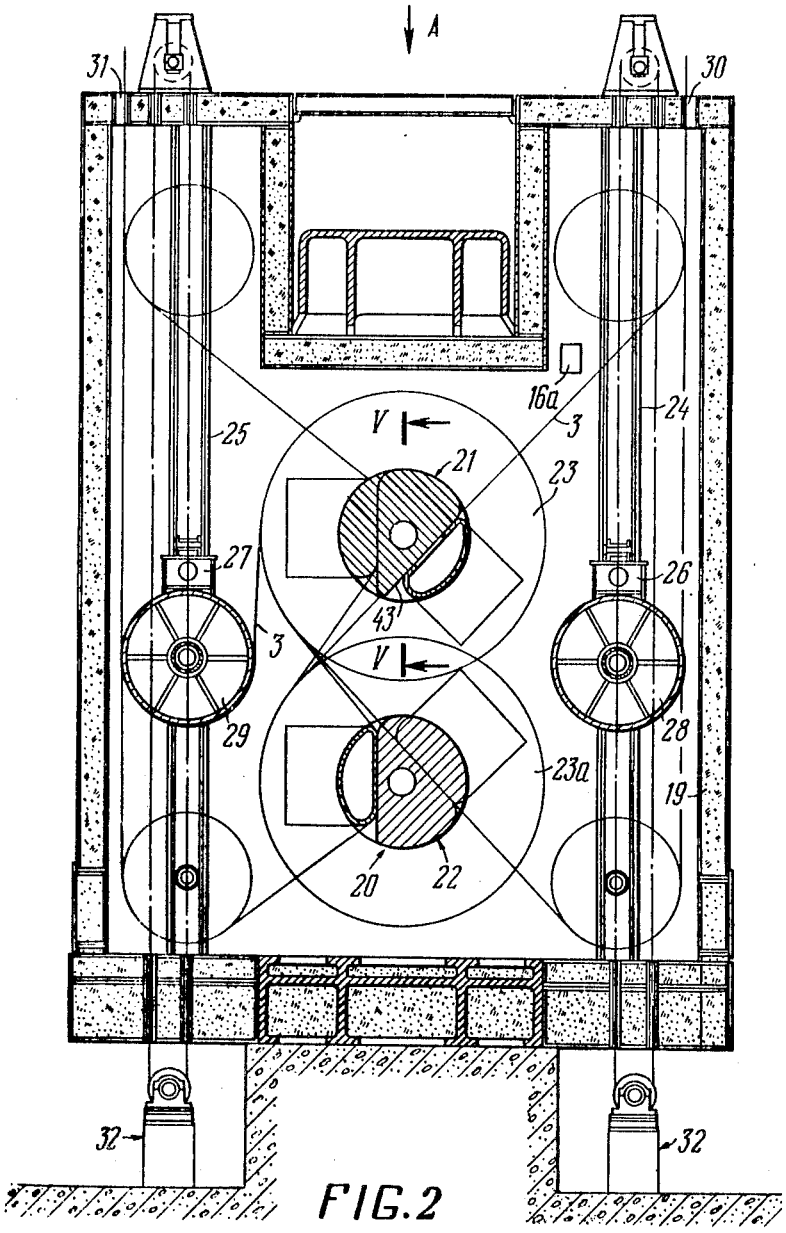
FIG. 2 is a longitudinal section of the furnace according to the invention.

The section 17 of the furnace 9 contains a thermoinsulated cell 19 (FIG. 2). Disposed inside the cell are heating elements **16*a* (FIG. 1) and a device 20 (FIG. 2) for supporting the metal strip in its constrained motion in this cell during the heat treatment, i.e., in the process of soaking the strip in the cell 19** for a preset time.

A device 20 is made up of two parallel drums 21 and 22 used for winding up the strip 3 into bifilar coils 23 and **23*a* respectively. Secured inside the cell 19 in parallel to the plane passing through the axes of rotation (geometric axes) of the drums 21 and 22 on both sides thereof are guides 24 and 25 accommodating carriages 26 and 27 carrying a pair of guide rolls 28 and 29** respectively.

The roll 28 at the strip inlet side of the cell 19 serves for placing the strip 3 onto the drums 21 and 22. For the strip entry the chamber 19 is provided with a hole 30.

The roll 29 disposed at the strip 3 outlet side of the cell 19 serves for discharging this metal strip 3 from the drums 21 and 22. For this strip output the cell 19 is provided with a hole 31.

Self-contained chain drives 32 are used for moving the carriages 26 and 27 along the guides 24 and 25.

Figure 3:
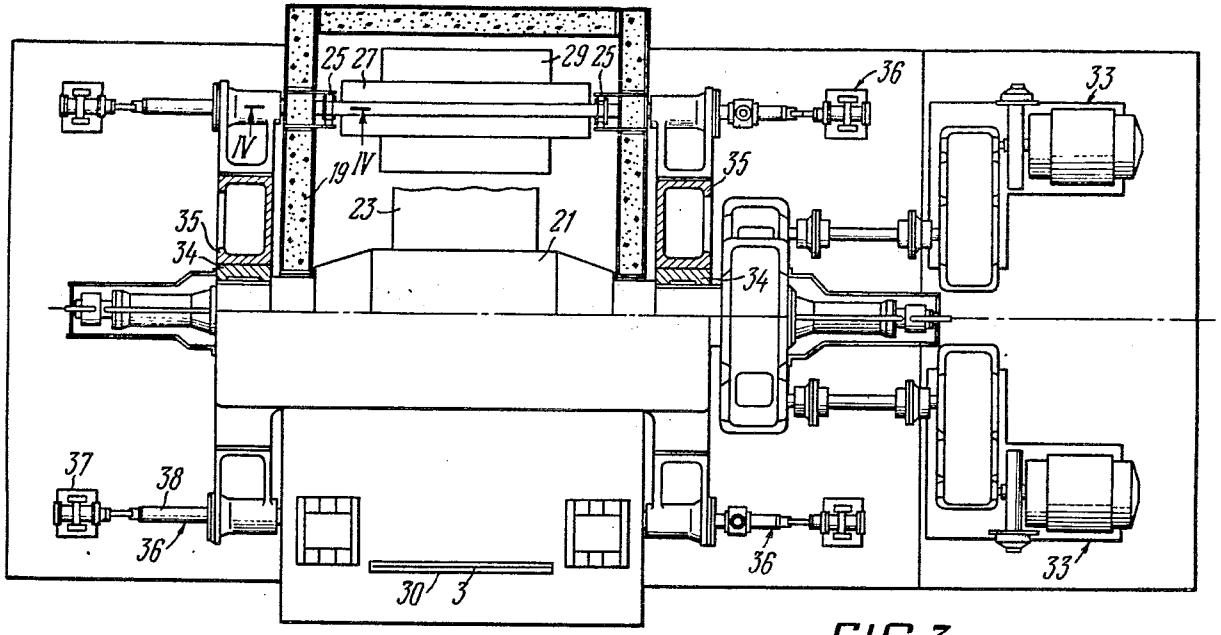
FIG. 3 is a top view of the same furnace along arrow A with a cut-out section along the axis of symmetry.

The drums 21 and 22 are pivoted with a possible reversed rotation in the opposite directions relative to each other. For the purpose each of the drums 21 and 22 is provided with a self-contained drive 33 (FIG. 3). The drums 21 and 22 are installed in bearings 34 placed on a bed 35.

Figure 4:
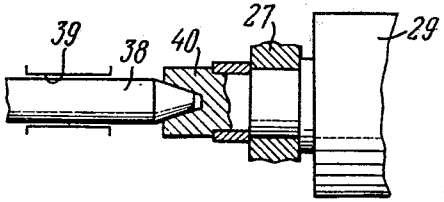
FIG. 4 is a section IV—IV of FIG 3.

For fixing the guide rolls 28 and 29 in the preset positions relative to the drums 21 and 22 use is made of locking means 36 each of them having a drive 37 connected with a pin 38 (FIGS. 3, 4) moving in guides 39 made in the bed 35. In its movement this pin enters a recess made in the axle 40 of the roll 29. The locking means 36 for the rolls 28 and 29 are identical and therefore all the features relating to one of them relate to both in an equal grade.

Figure 5:
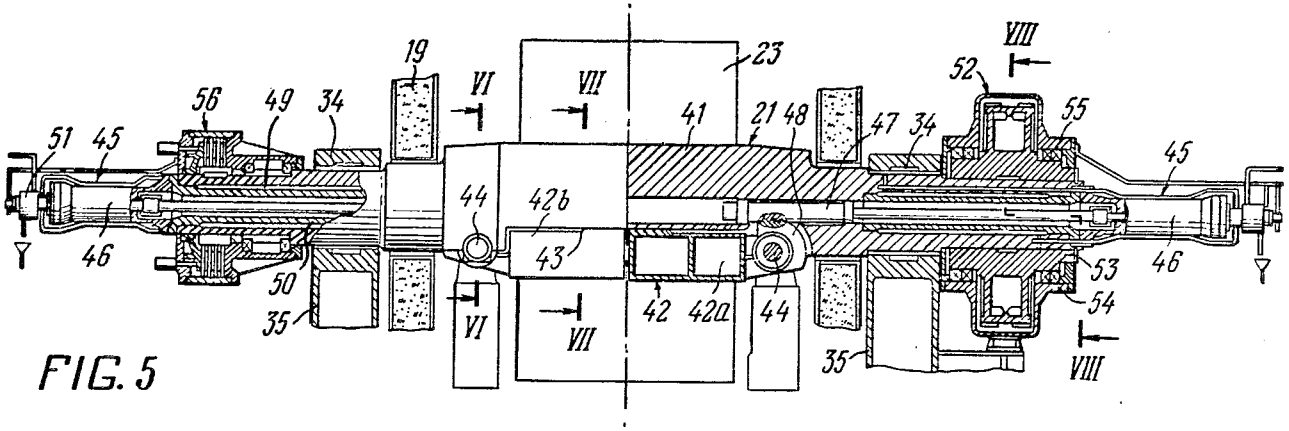
FIG. 5 is a section V—V of FIG. 2.

The drums 21 and 22 are also identical and therefore in the further discription all the features relating to one of them relate to another in an equal grade. The drum 21 is collapsible comprising two parts 41 (FIG. 5) and 42 with a longitudinal plane of attachment for placing the metal strip 3 between the contacting surfaces 43 of these parts.

In the further description the part 41 of the drum 21 is called a shaft meanwhile the part 42 in its turn comprises two segments 42*a* and42*b*.

The segments 42*a* and 42*b* relative to the shaft 41 are pivoted with a possible forced turn respectively about axles 44 secured on the shaft 41 perpendicular to the axis of rotation of the drum 21. When rotating the segments 42*a* and 42*b* about the axles 44 the part 41 and 42 of the drum 21 are separated from each other for placing the strip 3 therein and for discharging the strip 3 therefrom (FIG. 2).

Figure 6:
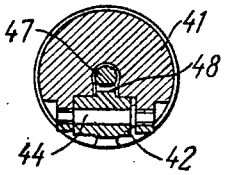
FIG. 6 is a section VI—VI of FIG. 5.

Hydraulic drives 45 are used for a forced turn of the segments 42*a* (FIG. 5) and 42*b*. Each of said hydraulic drives has a hydraulic power cylinder 46 whose rod is connected with a gear rack 47 (FIGS. 5, 6) engaged with a toothed sector 48. The sector 48 is secured on each of the segments 42*a* and 42*b*.

For cooling each end of the shaft 41 (FIG. 5) of the drum 21 use is made of an annular cavity 49 confined with a recess in the shaft 41 and a bush 50. Coolant liquid is supplied into the cavity 49. A swivel 51 serves to supply coolant liquid to the cavity 49 and working liquid to the hydraulic power cylinder 46.

To reduce the torque oscillations on the shaft 41 of the drum 21 the latter is rotated by a drive through a hanged reducer 52 whose drive gear 53 is secured directly on the shaft 41 meanwhile the reducer housing 54 rests through bearings 55 on this gear.

For a quick braking of the drum 21 a powerful friction brake 56 is mounted on the end of the shaft 41 of the drum 21 opposite to the hanged reducer 52.

Figure 7:
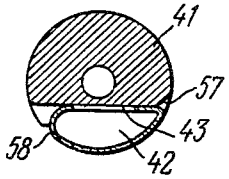
FIG. 7 is a section VII—VII of FIG. 5.

At the bends of the strip 3 (FIG. 2) about the shaft 41 (FIG. 5) and the part 42 they are provided with roundings 57 (FIG. 7) and 58 respectively of such a radius that eliminates a possible break of the strip 3 when bending about these roundings.

Figure 8:
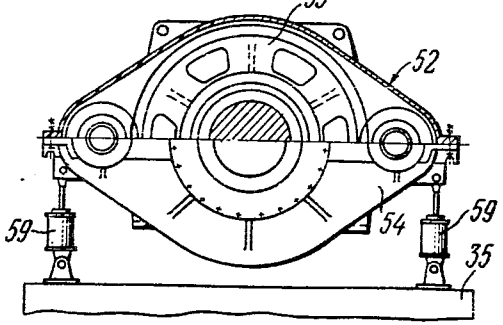
FIG. 8 is a section VIII—VIII of FIG. 5.

To preclude a turn of the hanged reducer 52 use is made of spring or hydraulic type shock absorbers 59 (FIG. 8) connecting the housing 54 of the hanged reducer 52 to the bed 35.

A similar arrangement is used to preclude a turn of the brakes 56.

The furnace having a device to support the metal strip according to the invention is of simple design providing that the strips are placed onto the drums 21 and 22 under tension meanwhile they are discharged therefrom without tension or under a small tension and can be applied for a heat treatment of a comparatively thick metal strip or when the strip has a high strength without a considerable residual plastic deformation in the form of a coil curvature which would impede the opening of the segments 42 when discharging this strip.

Figure 9:
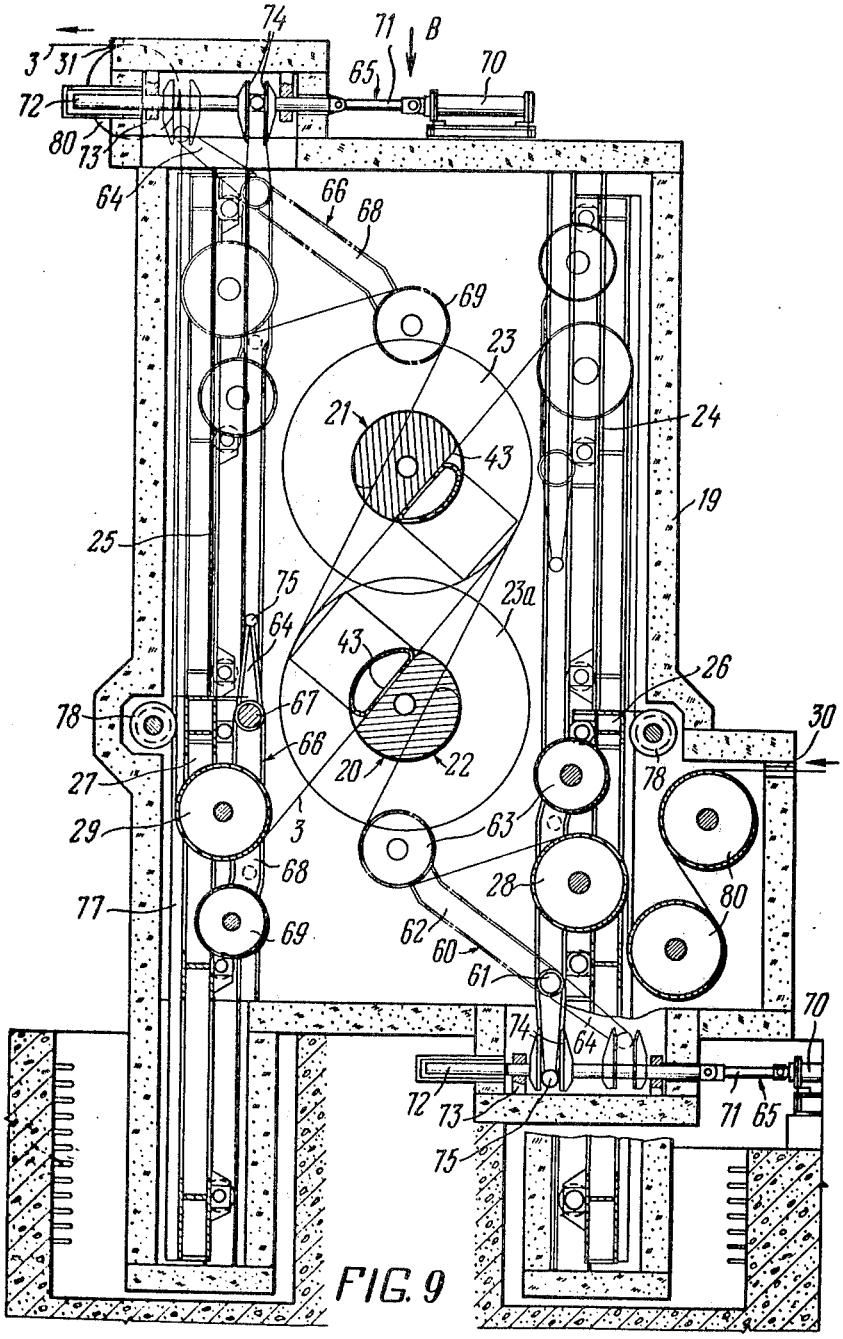
FIG. 9 is a longitudinal section of another embodiment of the furnace according to the invention.

If it is possible that the segments 42*a* and 42*b* in their opening can damage the strip 3, it is preferable to use the furnace with the device for supporting the metal strip 3 having another embodiment as shown in FIG. 9, 10. In this embodiment the carriage 26 arranged in the thermoinsulated cell 19 at the hole 30 side where the strip 3 is fed into the cell and carrying the guide roll 28 used for inserting this strip 3 under tension into the drum 21 accommodates a lever 60 with an axle 61 of rotation parallel to the axis of the guide roll 28. Mounted on the arm 62 of the lever 60 is an additional guide roll 63 parallel to said roll 28 and used for inserting the strip 3 under tension into the drum 22. Another arm 64 of the lever 60 in course of inserting the strip 3 into the drum 22 actuates the drive 65 for turning the lever 60 with the roll 63 in such a way that the metal strip 3 enveloping under tension this roll should pass through the surface 43 of attachment of the drum 22.

Mounted on the carriage 27 arranged in the cell 19 at the hole 31 side where the metal strip 3 is fed from the cell 19 and carrying the guide roll 29 used for discharging the strip under tension from the drum 22 is a lever 66 with an axle 67 of rotation parallel to the axis of the guide roll 29. The arm 68 of the lever 66 accommodates an additional guide roll 69 parallel to said roll 29 and used for discharging the strip 3 under tension from the drum 21. Another arm of the lever 66 in the course of inserting the strip 3 into the drum 21 actuates the drive 65 for turning the lever 66 with the roll 69 in such a way that the strip 3 enveloping under tension this roll should pass through the surface 43 of attachment of the drum 21.

Each drive 65 for turning the levers 60 and 66 comprises a hydraulic power cylinder 70 connected through a rod 71 with a pusher 72. The pusher 72 moves along the guides 73 and has jaws 74 accommodating a roll 75 connected with the lever 60 or 66 respectively.

Figure 10:
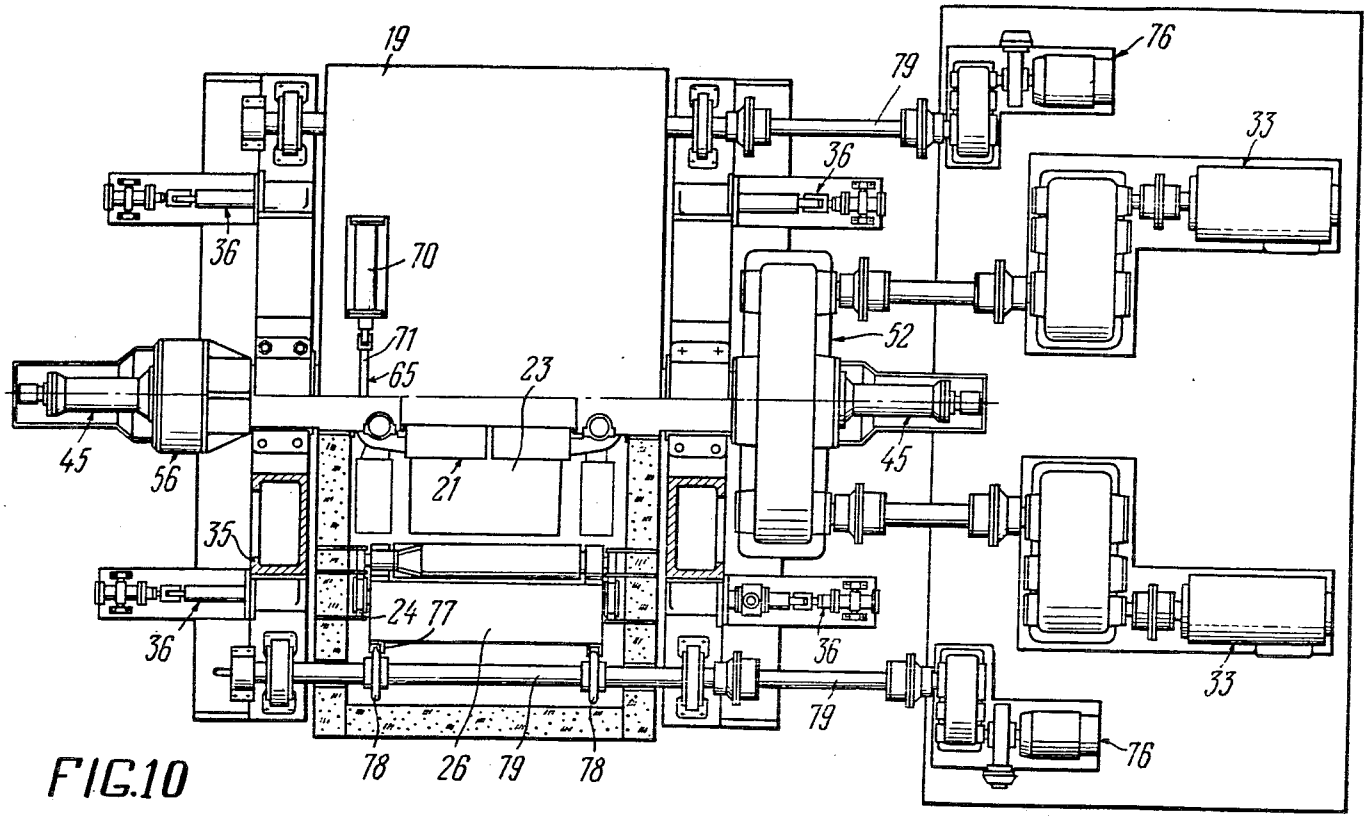
FIG. 10 is the same view along arrow B of FIG. 9 with a section cut-out along the axis of symmetry.

Thus, in the furnace shown in FIGS. 9 and 10 the sheet metal strip 3 is inserted into the drums 21 and 22 and discharged therefrom under tension.

In this furnace each of the carriages 26 and 27 is moved by its proper gear rack drive 76 (FIG. 10).

The gear rack drive 76 comprises a gear rack 77 secured on the houding of the carriage 26 or 27 respectively and a gear 78 engaged with this rack and connected through a shaft 79 with a reducer of the drive 76.

As in the furnace made according to the first embodiment the carriages 26 and 27 are fixed in the definite positions by locking means 36 similar to those described above.

To provide a required direction of motion of the strip 3 at the inlet hole 30 and the outlet hole 31 of the thermoinsulated cell 19 use is made of guide rolls 80 (FIG. 9) rotating relative to the fixed axles.

In the places of the strip inlet hole 30 and the strip outlet hole 31, in the holes for the drums 21 and 22 as well as in the holes for the chain drive 32 or in the holes for the pusher 72, guide rolls 80, gears 78 the cell 19 is provided with seals (not shown).

The continuous metal strip heat-treatment plant operates as follows:

The coils 2 of the non-heat treated metal strip are placed onto the uncoilers 1. From these uncoilers 1 the strip 3 is fed into the furnace 9. In the furnace 9 the strip is heated in the section 16 of the furnace, soaked in the section 17 and chilled in the section 18.

Since the strip 3 is exposed to heating and chilling being uncoiled these operations are very quick. The operations carried out for some seconds or minutes compared with a number of hours when carrying out the heat treatment in hood-type furnaces.

The heat treated strip 3 from the furnace 9 is fed to the coilers 12 wherein said strip is wound into the coils 13. When the coiling is finished the coils 13 are removed from the coilers, bound and delivered to a storehouse.

In the section 16 of the furnace 9 the strip 3 is heated to heated to a required temperature and fed into the strip inlet hole 30 of the cell 19 whereas in the section 17 of the cell 19 the strip 3 is soaked for a required time (up to a number of hours) at a preset temperature.

For example, the metal strip taken from a hot zinking plant and used for intricate and complicated stretching when stamping is soaked in the thermoinsulated cell 19 for 1–3 hours at a temperature of 350°–400° C.

When soaking the strip 3 in the thermoinsulated cell 19 of the furnace its two branches in turn is wound into two-layer (bifilar) coils 23 and 23*a* onto the drums 21 and 22 as well as unwound in turn from these drums.

Assume a process of soaking the metal strip 3 in the thermoinsulated cell 19 of the furnace made according to another embodiment as shown in FIGS. 9, 10.

The operation of the device 20 for supporting the metal strip 3 in the process of soaking it in the thermoinsulated cell 19 is shown in FIG. 11–15 from the moment when the strip is wound into the two-layer coil 23 onto the drum 21 and unwound from the two-layer coil 23*a* onto the drum 22 (FIG. 11). Hence one branch of the strip fed into the cell 19 is wound onto the drum 21 into the coil 23 meanwhile another branch of the strip 3 unwound from the coil 23*a* is wound onto the drum 22. From the coil 23*a* one branch of the strip 3 is wound into the coil 23 (another branch is wound onto the drum 21) meanwhile the other branch is fed from the cell 19 to the section 18 for chilling the strip. In the process of this rewinding the strip 3 at the strip inlet hole 30 and the strip outlet hole 31 of the cell 19 moves continuously in one sense. In the process of rewinding the guide rolls 28 and 29 with the carriages 26 and 27 are fixed in the position shown in FIG. 11 by the locking means 36. The strip 3 fed into the cell 19 envelops the roll 28 meanwhile the strip fed from the cell envelops the roll 29. The levers 60 and 66 with additional guide rolls 63 and 69 are in the starting position separated from the drums 21 and 22 as shown in FIG. 11. In each drum 21 and 22 the strip 3 is clamped along the surfaces 43 contacting the segments 42*a* and 42*b* to the shaft 41. The drums 21 and 22 are rotated in the opposite directions by their proper drives 33. The arrows in FIGS. 11 and 12 show the direction of the motion of the strip 3.

Before finishing the unwinding of the coil 23*a* from the drum 22 the pins 38 of the locking means 36 are disengaged from the axles 40 of the rolls 28 and 29 and the carriages 26 and 27 by their drives 76 each is moved into a lower position as shown in FIG. 12. The drive 65 moves the lever 60 with the roll 63 to the drum 22. When the strip 3 is completely uncoiled from the drum 22 the drums 21 and 22 are stopped by the brakes 56. Hence the drum 22 is stopped in such a way that its segments 42*a* and 42*b* should face the strip outlet hole 31 of the cell 19 meanwhile the surface 43 of attachment should be parallel to the strip 3 stretched between the coil 23 and the guide roll 29. Thereafter the segments 42*a* and 42*b* are opened by the drives 45 releasing the strip 3 stretched between the coil 23 and the roll 29. When the carriage 27 moves upwards to the starting position a portion of the strip 3 is separated from the drum 22. To prevent a sagging of the strip in the process of its discharging from the drum 22 said strip is fed into the outlet hole 31 of the cell 19. When the discharge of the strip 3 from the drum 22 is finished one branch of the coil 23 on the drum 21 can be fed out the cell 19.

When the discharge of the strip 3 is finished or simultaneously with said operation the drum 22 rotates in such a way that the open segments 42*a* and 42*b* face the strip inlet hole 30 of the cell 19 and is stopped in the position when the surface 43 of attachment of this drum should be parallel to the strip 3 stretched between the coil 23 and the roll 63. This strip is to be naturally under tension. By drives 45 the segments 42*a* and 42*b* of the drum 22 are closed thus clamping the strip 3 along the surface 43.

The drive 65 returns the lever 60 with the roll 63 into the starting position and the drive 76 sets the carriage 26 into the operating position as shown in FIG. 13. The rolls 28 and 29 are fixed by the locking means 36. Thereafter the winding of the two-layer coil 23*a* begins onto the drum 22 from two branches of the strip 3 fed into the cell 19 and unwound from the two-layer coil 23 wound before onto the drum 21. The before wound coil 23 is unwound whereas one branch of the strip 3 is wound into the coil 24 meanwhile the second branch is fed into the strip outlet hole 31 of the cell 19. In the process of this coiling the strip at the strip inlet hole 30 and strip outlet hole 31 of the cell 19 moves continuously at the same direction.

Before finishing the unwinding of the coil 23 from the drum 21 the pins 38 of the locking means 36 are disengaged from the axles 40 of the rolls 28 and 29 and the carriages 26 and 27 moves to the upper position. The drive 65 moves the lever 66 with the roll 69 to the drum 21 (FIG. 14). When the strip 3 is uncoiled fully from the drum 21 the drums 21 and 22 are stopped. The drum 21 is stopped so that its segments 42*a* and 42*b* should face the strip outlet hole 31 of the cell 19 meanwhile the plane of attachment should be parallel to the strip 3 stretched between the coil 23*a* and the roll 69. Thereafter the segments 42*a* and 42*b* of the drum 21 are opened by drives 45 thus releasing the strip 3 stretched between the coil 23*a* and the roll 69. The lever 66 with the roll 69 returns to the starting position, thus discharging the strip 3 from the drum 21. To prevent the sagging of the strip in the process of its discharge from the drum 21 said strip is fed into the strip outlet hole 31 of the cell 19. When the discharge of the strip 3 from the drum 21 has been finished one branch of the coil 23*a* on the drum 22 can be fed from the cell 19.

When the discharge of the strip 3 from the drum 21 has been finished or simultaneously with this operation the drum 21 rotates so that the open segments 42*a* and 42*b* face the strip inlet hole 30 of the cell 19 and is stopped in the position when the plane of attachment of this drum should be parallel to the strip 3 stretched between the coil 23*a* and the roll 28. The drives 45 close the segments 42*a* and 42*b* of the drum 21 thus clamping the strip 3 between the surfaces 43.

The drive 65 returns the lever 66 with the roll 69 to the starting position meanwhile the carriages 26 and 27 are set into the operating position (FIG. 11). The locking means 36 are introduced into the axles of the rolls 28 and 29. Thereafter the winding of the two-layer coil 23 onto the drum 21 and unwinding of the coil 23*a* wound before onto the drum 22 begin. The cycle of operation of the device 20 is repeated.

An analysis of the operation of the device 20 beginning from the position shown in FIG. 12 permits to note that when winding the coil 23*a* (FIG. 13) the inner branch fed from the strip inlet hole 30 is in the cell 19 for $\tau$ hours wherein $\tau$ stands for a time required for winding the coil 23*a* meanwhile the outer branch of this strip is therein for O hour. At the subsequent winding of the coil 23 and unwinding of the coil 23*a* (FIG. 11). The branch of the strip 3 is wound from the coil 23*a* into the coil 23 and all the portions of the strip passes the same soaking equal to $\tau$ hours. However the branch of the strip 3 being outer in the coil 23*a* becomes inner and on the contrary.

At the subsequent unwinding of the coil 23 (FIG. 13) the outer branch of the strip 3 which has passed the time of soaking equal to two $\tau$ hours is fed at once from the cell 19 meanwhile the inner branch is soaked in this cell for a time required to unwind the coil 23, i.e., for $\tau$ hours. Thereafter this branch is also fed out the cell 19. The summary time for this branch of the strip in the chamber 19 is also equal to 2 $\tau$.

Hence it appears that:

a. The duration of the soaking of all the portions of the strip in the cell 19 is equal (the time for replacing the strip 3 due its inconsiderable amount compared with the time for winding the coils 23 and 23*a* onto the drums 21 and 22 can be disregarded).

Taking into account that the strip 3 is continuous and moves continuously through the cell 19 in the same direction for the time of soaking it in this cell it is possible to come to a conclusion that the furnace 9 according to the invention has all the typical and positive features of a throughtype furnace.

b. The time of soaking any portion of the strip 3 in the chamber 19 is equal to 2 $\tau$ (hours) wherein $\tau$ stands for a time required to wind (or unwind) the two-layer coils onto the drums 21 and 22, in hours.

Since the weight of the two-layer coil 23 or 23*a* is equal to $$G=2A\tau$$

wherein G defines the weight of the two-layer coil in tons

A defines the hour capacity of the continuous strip heat treatment plant, in *t/h* meanwhile at present the weight of the strip coil G=60–70 *t* and the hour capacity of the plant A = 70 *t/h* (i.e., year capacity of the plant is equal to 500,000 t/year) the time of soaking the strip 3 in the cell is equal to:

$$2\tau = 2_A^G = 2_{2.70}^{70} = 1 \text{ hour.}$$

Thus, it is possible to come to the second conclusion that the furnace 9 according to the invention provides the high capacity of the plant at comparatively small dimensions of the furnace making it possible to carry out a long soaking of the strip 3, thus combining the positive features of the hood-type furnaces.

It should be also noted that the furnace according to the invention can be easily built-in a line of devices where together with the heat treatment other operations of treating the strip are carried out and more particularly said furnace can be built-in the strip zinking plants behind the zinking machine when it is necessary to obtain a zinked strip for a intricate and complicated stretching when stamping (cf. the modes of soaking the zinked strip in this furnace described above). This furnace permits to eliminate the necessity to transport the strip in coils from the strip zinking plant to separate installed furnaces, temper mill and to a cross cutting unit, thus eliminating any damage of the strip during these transports.

When discharging the strip 3 from the drums 21 and 22 and inserting the strip from said drums wherefrom the two-layer coil 23 or 23*a* is unwound fully the strip 3 is stopped at the strip inlet hole 30 and strip outlet hole 31 of the cell 19.

In view of the fact that some operations of replacing the strip 3 coincide in time, this time is equal to:

$$\tau_{repl} = 0.5\,\tau_1 + \tau_2 + \tau_3 + \tau_4 + 0.5\,\tau_5$$

wherein $\tau_1$ defines the time for stopping the drums 21 and 22 before discharging the strip from one of them. Since for this time the strip 3 moves at the inlet and outlet of the cell and assuming with a sufficient accuracy that this time is equislowed, the factor is assumed equal to 0.5.

Since the powerful drives 33 for rotating the drums 21 and 22 are used and the powerful friction brakes 56 are placed on these drums, the duration $\tau_1$ is equal to some seconds.

$\tau_2$ defines the time for opening the segments 42*a* and 42*b* of the drums 21 and 22 when the strip 3 is discharged therefrom. Since the drives 45 rotate comparatively light segments, the duration $\tau_2$ is also inconsiderable being equal to some seconds.

$\tau_3$ defines the time for rotating the drums 21 and 22 by the drive 33 when the strip has been discharged therefrom. Since the drum is free of the coil, the time for rotating the drum is inconsiderable being equal to some seconds.

$\tau_4$ defines the time for closing the segments 42*a* and 42*b* of the drums 21 and 22 when replacing the strip 3 thereon. All the explanations with reference to $\tau_2$ relate also to $\tau_4$.

$\tau_5$ defines for speed up the drums 21 and 22 when the strip replacing has been finished onto one of them. All the explanations with reference to $\tau_1$ relate also to $\tau_5$. The increased time for speeding up the drum compared with the braking time in view of the presence of a friction brake can be easily compensated by installing flywheels in the drives 33 rotating permanently and by arranging between said drives and the respective drums 21 and 22 a friction clutch.

As a whole the time $\tau$ replacing is also inconsiderable being equal to some tens of seconds (10–60 sec). To provide a continuous operation of the other devices of the continuous strip heat-treatment plant during the replacing of the strip into the drums the loopers 7 should be installed with a corresponding stock of the strip 3 thereon.

The operation of the device 20 for supporting the metal strip 3 in the course of its soaking in the thermoinsulated cell 19 of the furnace according to the first embodiment is similar to that of said device 20 of the furnace according to another embodiment.

The process of winding a two-layer coil 23 onto the drum 21 and unwinding the before wound coil 23*a* onto the drum 22 as shown in FIG. 15 is similar to the process described for the position shown in FIG. 11.

Before finishing the unwinding of the coil 23*a* the locking means 36 release the rolls 28 and 29 and the carriages 26 and 27 whereas each carriage is moved downwards by its proper drive 32. When the coil 23a is fully unwound from the drum 22 the drums 21 and 22 are stopped whereas the drum 22 is stopped by the segments 42*a* and 42*b* towards the guides 25 (FIG. 16) in such a way that the plane of attachment should be parallel to the plane of the geometric axes of the drums 21 and 22. Hence at a small tension of the strip 3 clamped onto the drum 22 the segments 42*a* and 42*b* of this drum open. The strip 3 is discharged from the drum 22 by withdrawing this strip to the strip outlet hole 31 of the cell 19.

Thereafter or simultaneously with the discharge of the strip 3 the drum 22 rotates so that the open segments 42*a* and 42*b* face the guides 24 and is stopped in such a position that the plane of attachment should be parallel to the strip 3 stretched between the coil 23 and the roll 26. The segments 42*a* and 42*b* are closed, clamping the strip 3 between the contacting surfaces 43.

The carriages 26 and 27 are arranged in the operating position (FIG. 17) and the locking means 36 are introduced into the axles of the rolls 28 and 29.

The process of winding the two-layer coil 23*a* onto the drum 22 and unwinding the coil 23 wound before onto the drum 21 (FIG. 17) is similar to the operation described for the position shown in FIG. 13.

When the coil 23 is unwound from the drum 21 the strip 3 is discharged and the subsequent strip is replaced onto this drum as shown in FIG. 18. These operations are similar to the discharge of the strip 3 and the replacing thereof onto the drum 22 (FIG. 14).

The time for soaking the strip 3 in the cell 19 of the furnace and time losses for replacing the strip (discharge and insert of the strip) on the drums in this case are equal to those in the furnace according to another embodiment.

The device 20 of the furnace according to the first embodiment has a more simple design. However the discharge of the strip 3 from the drums in this case is carried out at the minimum tension and therefore in view of a danger of damaging this strip with the segments 42*a* and 42*b* and of malfunctions in the operation of the device 20 this embodiment of the device can be used in the above-mentioned causes.

At the same time the furnace according to another embodiment ensures the insert of the strip and its discharge from the drums 21 and 22 under a sufficient tension thus eliminating the danger of damaging the strip 3 during its replacing and minimizing the danger of malfunctions in the operation of the device 20 and therefore this furnace can be used for the strips of any types. However the presence of excessive mechanisms, i.e., levers 60 and 66 with rolls 63 and 69 inside the cell 19 having a comparatively high temperature intricates the design of the furnace.

The application of the embodiments of the furnace should be solved in specific cases by taking into account all the circumstances.

We claim:

1. A furnace for a continuous metal strip heat treatment plant comprising: a heat-insulated cell having an inlet and an outlet for the metal strip; heating elements arranged within said cell, and means for moving said strip within said cell in the course of heat treatment, said means including: at least a pair of coiling drums disposed substantially parallel to each other and having separable segments split along the longitudinal plane of said drums for clamping said strip and coiling it in a bifilar manner and uncoiling it successively on said drums; drives for reversing the rotation of said drums and further drives for opening and closing said segments; at least a pair of guide rolls disposed within said heat-insulated cell, one of the guide rolls of said pair of rolls being arranged within said cell at the inlet for said strip and intended for alternately feeding the strip to the coiling drums before it is coiled thereon in a bifilar manner, and the other one of said guide rolls of said pair being arranged within said cell at the outlet for said strip for alternately discharging the strip from the coiling drums after the bifilar coil has been wound; each of the rolls of said pair of guide rolls being mounted within said cell on a carriage to move thereon for feeding the strip into the coiling drums and discharging it therefrom in a plane substantially parallel to the plane passing through the axes of rotation of the coiling drums; and drive means for moving said carriages.

2. A furnace for a continuous metal strip heat treatment plant comprising: a heat-insulated cell having an inlet and an outlet for the strip; heating elements arranged within said cell, and means for moving said strip within said cell in the course of heat treatment, said means including: at least a pair of coiling drums disposed substantially parallel to each other and having separable segments split along the longitudinal plane of said drums for clamping said strip and coiling it in a bifilar manner and uncoiling it successively on said drums; drives for reversing the rotation of said drums and further drives for opening and closing said segments; guides mounted fixedly in said cell at the inlet for said strip in a plane substantially parallel to the plane passing through the axes of rotation of the coiling drums; a carriage moving on said guides; a drive for moving said carriage; a guide roll mounted on said carriage and serving to feed the strip under tension into the first coiling drum; a lever mounted on said carriage; a pivotal axis of said lever secured to the carriage parallel to said guide roll; an additional guide roll mounted on said lever for feeding the strip under tension into the other coiling drum; a drive for turning said lever for positioning the additional deflecting roll relative to the other coiling drum so that the metal strip passing over the additional roll should pass through the plane along which the segments are separated from the other coiling drum; guides mounted fixedly in said cell at the outlet for said strip in a plane substantially parallel to the plane passing through the axes of rotation of the coiling drums; a carriage moving on said guides; a drive for moving said carriage; a guide roll mounted on said carriage and serving to discharge the strip under tension from the other coiling drum; a lever mounted on said carriage; a pivotal axis of said lever secured to the carriage parallel to said guide roll; an additional guide roll mounted on said lever for discharging the strip under tension from the first coiling drum; a drive for turning said lever for positioning the additional deflecting roll relative to the first coiling drum so that the metal strip passing over the additional roll passes through the plane along which the segments are separated from the first coiling drum.

3. A furnace as claimed in claim 1, wherein each guide roll of said pair is mounted on a carriage installed in the guides arranged in the thermoinsulated cell.

* * * * *